United States Patent [19]

Ware et al.

[11] 3,940,065

[45] Feb. 24, 1976

[54] PORTABLE SPRAYING APPARATUS

[75] Inventors: Lyle A. Ware, Bloomington; Dennis J. Sundelius, St. Paul; Marlin R. Melquist, Spring Lake Park, all of Minn.

[73] Assignee: Graco Inc., Minneapolis, Minn.

[22] Filed: Mar. 14, 1975

[21] Appl. No.: 558,209

[52] U.S. Cl. ..... 239/146; 239/15; 239/127; 239/286; 239/302; 239/526; 222/176; 222/405

[51] Int. Cl.[2] B05B 5/08; B05B 9/043; B05B 15/04; B05B 3/18

[58] Field of Search ..... 239/15, 3, 146, 199, 302, 239/124, 178; 222/176, 178, 405

[56] References Cited

UNITED STATES PATENTS

| | | | |
|---|---|---|---|
| 1,783,689 | 12/1930 | Angier | 222/176 X |
| 1,866,106 | 7/1932 | Herlihy | 222/176 |
| 2,594,501 | 4/1952 | Ruthman | 222/176 X |
| 2,596,074 | 5/1952 | Hawes | 239/127 |
| 2,808,048 | 10/1957 | Garrison | 239/127 X |
| 3,305,137 | 2/1967 | Gauthier et al. | 222/176 X |
| 3,471,089 | 10/1969 | Kock | 239/15 |
| 3,473,735 | 10/1969 | Drum | 239/3 X |
| 3,675,851 | 7/1972 | Merfeld et al. | 239/318 |
| 3,747,850 | 7/1973 | Hastings et al. | 239/3 |

*Primary Examiner*—Robert S. Ward, Jr.
*Attorney, Agent, or Firm*—Paul L. Sjoquist

[57] ABSTRACT

Apparatus is disclosed for spraying liquids, preferably paint, directly from a paint container mounted on the apparatus, wherein an electric drive motor, pump assembly, and paint container shelf are attached to a wheeled frame assembly for portable movement without disconnecting the paint container from the pump assembly, and wherein electrostatic voltage discharges are prevented by means of a common electrical interconnection of all electrostatic voltage-developing components.

6 Claims, 4 Drawing Figures

PORTABLE SPRAYING APPARATUS

BACKGROUND OF THE INVENTION

This invention relates to an apparatus for spraying paint, and more particularly to an apparatus for spraying paint under high hydraulic paint pressures wherein the entire apparatus and paint container are portable for access to a work station which may be remotely located from an electrical power source. The apparatus includes an electric motor for operation on conventional house power, and the apparatus is primarily intended for painting areas in and around houses and other buildings. The apparatus includes an electric extension cord for plugging into a normal 110 volt AC outlet.

Portable paint sprayers have been developed in the past for purposes similar to the present invention. They generally include an electric or gasoline powered pump mounted on a wheeled frame assembly for transporting to a work station. Once located at the work station, a paint container is placed nearby and is fluid coupled to the apparatus by means of a suction hose, and an attached spray hose with spray gun is utilized to enable the operator to spray paint at a distance of from 25 to 50 feet from the apparatus. When the apparatus is again moved to a new work station, it is disconnected from the paint container and wheeled to the new location. The paint container is hand-carried to the same location and again fluid coupled to the apparatus so that painting operations may continue.

The high hydraulic paint pressures utilized in an apparatus of this type create a problem of electrostatic voltage build up which must be dealt with. Paint fluid flow through these systems results in a frictional electrostatic charge accumulating on and along the components in contact with the paint. This electrostatic voltage build up if discharged suddenly, will cause a spark which could ignite paint fumes to create a fire or explosion. Prior art apparatus has minimized this problem by utilizing a grounded wire connected between the electric motor assembly and the paint spray gun to drain off any electrostatic potentials that would otherwise develop. Electrostatic potentials developed on or in the paint container itself are a lesser problem, and it has been assumed that these voltages discharge by virtue of the fact that the paint container is generally placed upon the ground. To the extent that electrical continuity is imperfect, there still remains an electrostatic discharge hazard in following this procedure, and it may be recommended by manufacturers of such equipment to provide an auxiliary ground connection between the paint container and the motor assembly.

SUMMARY OF THE INVENTION

The present invention comprises a portable paint cart having two wheels for transporting the entire painting apparatus, including the paint container. The paint cart utilizes a forwardly projecting metal frame which contacts the ground and serves to support the apparatus in a tripod fashion while it is being used. The apparatus utilizes a conventional electric motor-driven paint pump which receives its input via a suction hose clamped to the paint container and feeds its output over a suitable hydraulic hose and spray gun. The apparatus includes a hinged paint container shelf which may be placed in a vertical position for cleaning and draining excess paint accumulations and which may be placed in a horizontal position in supporting contact with the motor assembly for holding the paint container during painting operations. The apparatus also includes a rack for holding accumulated electric cord and paint hose, and for hanging hereon the spray gun when it is not in use. Because of the completely self-contained apparatus it enables the transporting of all equipment associated with the paint spraying operation from one work station to another without disconnecting or uncoupling the paint container from the assembly.

BRIEF DESCRIPTION OF THE DRAWINGS

A preferred embodiment of the invention is described herein, and in conjunction with the attached drawings, in which.

DETAILED DESCRIPTION

Figure 1:
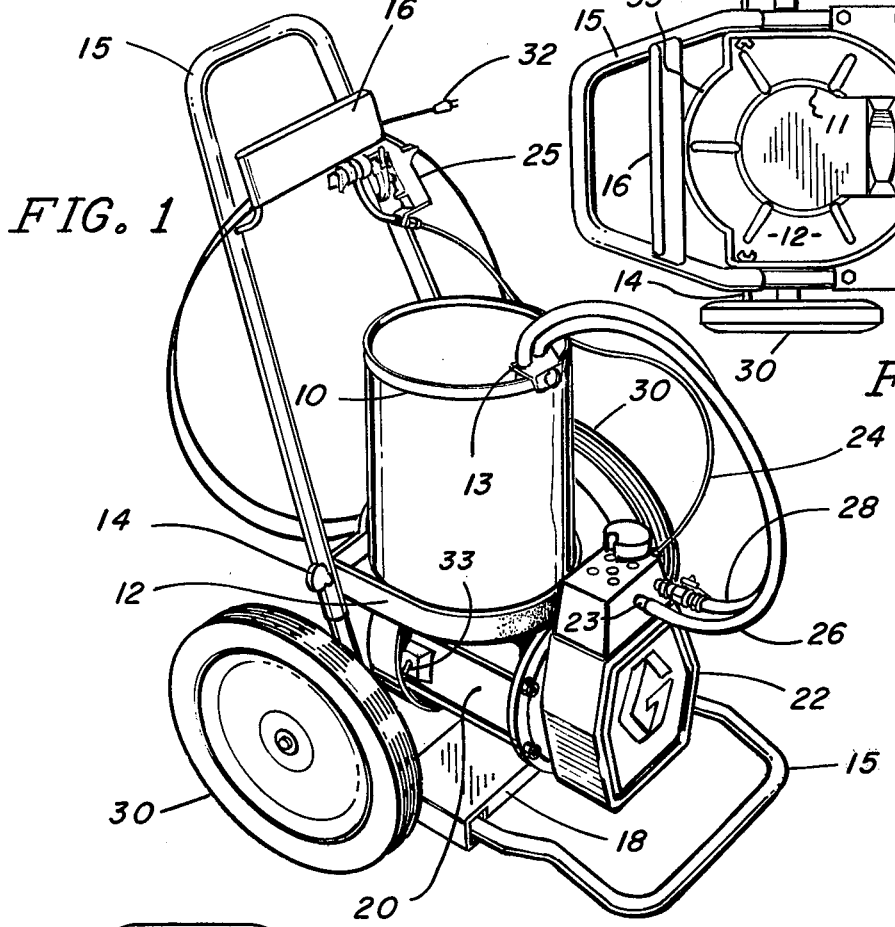
FIG. 1 illustrates the invention in isometric perspective view.

FIG. 1 shows the invention in perspective view, having a paint container mounted thereon. Paint container 10 is typically a standard 5 gallon paint can which snugly fits inside of the raised shoulder of shelf 12. Shelf 12 is hinged at points 14 by means of a pin pivotally attaching shelf 12 to tubular frame 15. Tubular frame 15 may be bent from a single tubular piece into the shape illustrated in FIG. 1; alternatively, frame 15 may be hinged at a convenient point along the handle portion for folding into a compact size for storage.

A frame support member 18 is bolted across two parallel tubular members of frame 15, for strengthening the apparatus and for providing a mounting surface for the motor and pump assembly. Electric motor 20 is securely bolted to this frame support member 18, and pump assembly 22 is bolted to the motor and driven thereby. Motor 20 may be any electric motor conveniently sized for this application, but preferably is constructed having an explosion proof motor casing. For example, electric motor model No. 1111513411, manufactured by Franklin Manufacturing Company, Bluffton, Indiana, has been found suitable for this purpose. Similarly, pump assembly 22 may be of any convential construction suitable for driving by a rotary shaft. In the preferred embodiment applicant has selected a diaphragm pump assembly for this purpose, which assembly obtains its rotary drive power from motor 20, and delivers paint via hose 24 at up to 0.25 gallons per minute, and 800 to 3,000 pounds per square inch (p.s.i.). A suction hose 26 is coupled between the pump inlet and the interior of container 10, and may be clamped to the edge of container 10 for support by means of a threaded clamp 13. Clamp 13 may be a simple U-clamp having a threaded wing nut for tightly securing against the container edge. The preferred embodiment has a return tube 28 connected between the pump 22 outlet and the paint container 10. Return tube 28 may also be clamped to the paint container edge by means of clamp 13.

The apparatus has a pair of wheels 30 rotatably attached to frame member 15. Wheels 30 project below the underside of frame support 18 to provide clearance for transporting the apparatus while maintaining as low a center of gravity as possible.

A bracket 16 is attached near the upper end of frame 15 for purposes of providing a support member for holding excess spray hose and electric cords. Rack 16 is also adapted for hooking thereon a paint spray gun, so that the entire apparatus and its associated hoses and equipment may be completely self-contained and supported while the apparatus is being moved.

An electric extension cord 32 is used to connect the apparatus with a convenient source of household power. An on-off switch 33, which may be actuated by foot control, controls the application of electric power to motor 20. When switch 33 is turned on, motor 20 operates and drives pump 22. Pump 22 draws paint from paint container 10 via suction hose 26, and pumps the paint at an elevated pressure through hose 24 to the paint spray gun 25. When the paint spray gun trigger is not actuated, pump 22 may be caused to recirculate paint back to the container via return tube 28.

One of the advantages of the invention which is apparent from FIG. 1 is the positive inlet pressure which is made possible by means of the construction illustrated. Because paint container 10 is elevated above the inlet 33 to pump 22, paint is continually delivered to pump 22 at a positive pressure. This positive pressure maintains a prime in hose 26 and enables pump 22 to immediately begin pumping paint as soon as motor 20 is turned on. This is true even after the apparatus has been moved from one location to another, for the movement of the apparatus does not disturb the paint prime in hose 26 nor does it require any intital setup prior to renewing the painting operation other than restarting motor 20.

Pump assembly 22 has a pressure control 17 for adjusting the fluid pressure of the material being sprayed. Control 17 is typically adjusted to provide the desired quality and quantity of fluid to be sprayed by spray gun 25, usually in the range of 800 p.s.i. – 2,000 p.s.i. This pressure may be relieved by opening priming valve 36, which fluid couples paint from pump assembly 22 directly back to container 10 via return tube 28.

Figure 2:
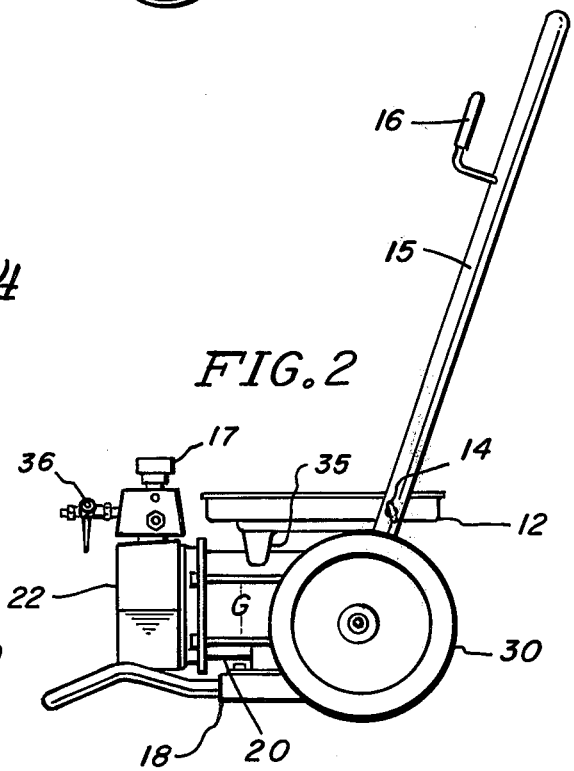
FIG. 2 shows a side view of the invention.

FIG. 2 illustrates the invention in side view, with a typical paint container shown in dotted outline. The apparatus is pivotal about the axle 31 of wheel 30 for transporting. The center of gravity of the apparatus is approximately at the position labeled G, which is well forward of the axle pivot point, and approximately at the same height. If a 5 gallon paint container is placed on shelf 12, the center of gravity of the apparatus still remains well forward of the axle 31, insuring stability of the apparatus even under conditions when the frame 15 is tipped for transporting purposes. The combined center of gravity of the paint container and apparatus is designed so that paint will spill from the container 10 before the apparatus becomes unstable and falls over on its handle as a result of tipping.

Figure 3:
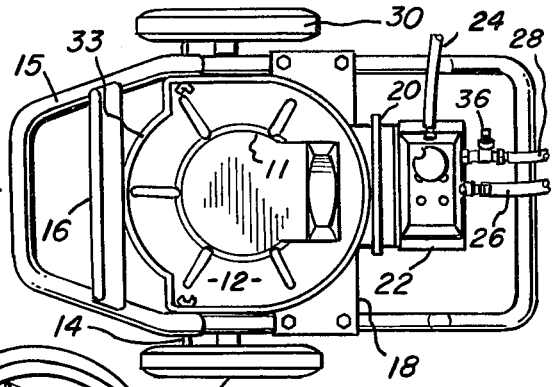
FIG. 3 shows a top view of the invention.
Figure 4:
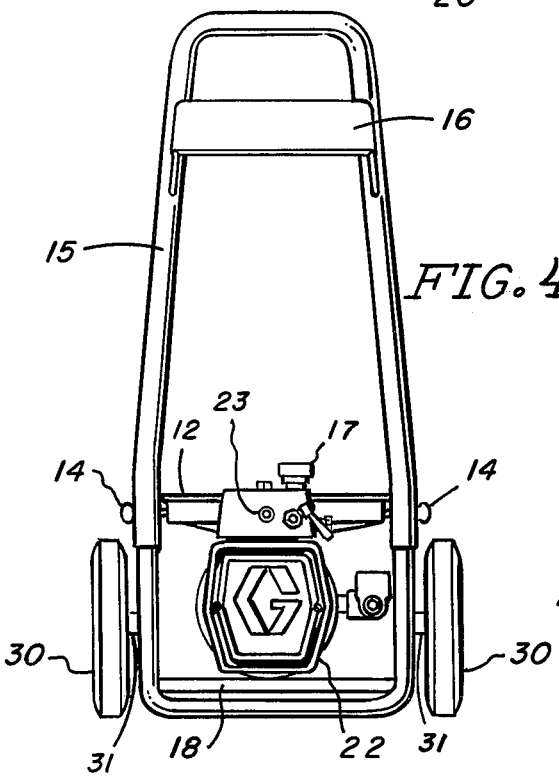

FIG. 3 illustrates the invention in top view. From this figure, it is apparent that the center point of shelf 12 is forward of axle 31. This again insures that the center of gravity, even in cases where a full paint container is placed on shelf 12 is forward of the pivot point for the apparatus. The raised edge of shelf 12 is sized so as to conveniently and snugly accept a standard 5 gallon paint container. A center recessed portion 11 of shelf 12 is sized to snugly accept a standard 1 gallon paint container. Thus, either of these paint containers will fit within shelf 12 and will be supported by an edge shoulder for stability.

In operation, the paint container 10 is placed on shelf 12 and suction hose 26 is inserted into the paint within the container. Hose clamp 29 is threadably clamped to the edge of the paint container to secure the suction hose and return tube. During initial startup it is necessary to prime the pump and paint delivery hose. This is accomplished by opening priming valve 36 and then turning on switch 33. Priming valve 36 couples return tube 28 to the pump and provides a predetermined and fixed pressure load from the pump back to container 10. This load is overcome by the pump, and paint is drawn through suction hose 26 and recirculated back to container 10 via return tube 28 until priming valve 36 is shut off. Once recirculation has begun in this manner priming valve 36 may be shut off and the spray gun may be actuated for painting. Whenever spray gun 25 is triggered, the pump draws paint from the paint container and forces it out through the paint delivery hose under high pressure. When the paint spray gun trigger is released, spraying stops but the suction hose 26 and paint hose 24 remain full of paint and fully primed for the next painting operation. Under this condition, the motor may be turned off, and the apparatus may be moved from one location to another, and when the motor is again restarted the pump assembly will immediately begin delivering paint upon actuation of the spray gun trigger. Since the paint container is always elevated above the pump assembly the pump prime, once established, remains developed under the pressure head caused by the difference in elevation between the container and the pump.

The build up of electrostatic voltages is common in apparatus of this type, and is caused by the frictional flow of paint through the system. It is important, therefore, to provide an electrical ground to all portions of the apparatus where electrostatic voltages could otherwise develop, so as to eliminate the possibility of an electrical spark igniting paint or paint fumes. The electric cord 32 has an electrical ground connection which is connected to the chassis of motor 20. Since motor 20 is securely bolted to frame support 18 and frame 15 the entire frame is electrically grounded. Shelf 12 is preferably made of metal and is attached to frame 15 so as to insure that it is grounded, and since paint container 10 is inserted into the recess of shelf 12 it contacts the electrical ground also. In order to improve the electrical connection between container 10 and shelf 12 it may be desirable to construct shelf 12 with a corrugated surface, or other surface having sharp projections thereon. An alternative or additional approach to electrically grounding paint container 10 is to provide a ground wire attached to either suction hose 26 or return tube 28, having one of its ends connected to the motor chassis and its other end connected to clamp 29.

Of course, a ground wire is also provided in paint hose 24, connecting spray gun 25 electrically to the motor chassis in a manner which has been done previously in the art. All these electrical connections provide a common grounding network for portions of the apparatus having paint contact or paint flow therein, thereby eliminating the usual problems associated with static electricity otherwise found in similar paint sprayers.

What is claimed is:

1. Apparatus for spraying liquids from a container and for portable relocation to a work site without disconnecting the liquid coupling and spraying members, comprising:

a. an L-shaped frame member having wheels mounted on axles near the intersection of the horizontal and vertical frame legs;

b. a motor and pump assembly rigidly attached to the horizontal leg of said frame member;

c. a liquid container shelf pivotally mounted along said frame member vertical leg and supported in a substantially horizontal position by said motor and pump assembly, whereby said shelf is elevated above said pump assembly and has its load-bearing center forward of said wheel axles;

d. a suction hose and a recirculating hose attached to said motor and pump assembly and having means for attachment to said liquid container;

e. spraying means, attached to said motor and pump assrmbly, for delivering sprayed liquid pumped by said motor and pump assembly; and f. electric circuit means for interconnecting said spraying container shelf to a common electrical potential.

2. Apparatus as claimed in claim 1, wherein said liquid container shelf further comprises a raised edge sized for snugly enclosing a liquid container of a first capacity, and a recessed center portion for snugly enclosing a liquid container of a second capacity.

3. A portable paint spraying apparatus having a motor-driven pump for withdrawing paint from a paint supply container and recirculating said paint and delivering said paint at elevated pressures for spraying from a spray gun, comprising:

a. a frame assembly having a base portion for attaching said motor-driven pump thereto, and having an upwardly extending handle portion;

b. a pair of wheels rotatably attached to said frame assembly and having their wheel surfaces extending below said base portion;

c. a paint container shelf attached to said frame assembly at a position elevated above said motor-driven pump and projecting forwardly to position its gravitational center point forwardly of said wheels attachment point; and d. means for electrically interconnecting said paint container shelf and said motor-driven pump to a common voltage ground.

4. The apparatus of claim 3, wherein said paint container shelf further comprises a circumferential lip for snugly encompassing said paint container.

5. The apparatus of claim 4, wherein said paint container shelf further comprises a central recessed portion for accepting a paint container of smaller size than said circumferential lip size.

6. The apparatus of claim 5 wherein said paint container shelf further comprises a pivotal mounting connection for attachment to said frame assembly, and a bottom saddle for supporting against said motor driven pump.

* * * * *